US009728321B2

(12) United States Patent
Kazakov et al.

(10) Patent No.: US 9,728,321 B2
(45) Date of Patent: Aug. 8, 2017

(54) TRANSFORMER WITH FERROMAGNETIC FOIL WINDINGS

(71) Applicants: Vladimir Viktorovich Kazakov, Kazan (RU); Oleg Vladimirovich Kazakov, Kazan (RU); Khamis Magsumovich Makhianov, Kazan (RU)

(72) Inventors: Vladimir Viktorovich Kazakov, Kazan (RU); Oleg Vladimirovich Kazakov, Kazan (RU); Khamis Magsumovich Makhianov, Kazan (RU)

( * ) Notice: Subject to any disclaimer, the term of this patent is extended or adjusted under 35 U.S.C. 154(b) by 338 days.

(21) Appl. No.: 14/602,577

(22) Filed: Jan. 22, 2015

(65) Prior Publication Data

US 2016/0217915 A1 Jul. 28, 2016

(51) Int. Cl.

| | |
|---|---|
| ***H01F 17/00*** | (2006.01) |
| ***H01F 27/30*** | (2006.01) |
| ***H01F 27/24*** | (2006.01) |
| ***H01F 27/28*** | (2006.01) |
| ***H01F 27/25*** | (2006.01) |
| ***H01F 30/06*** | (2006.01) |

(52) U.S. Cl.

CPC ..... *H01F 27/2847* (2013.01); *H01F 27/25* (2013.01); *H01F 30/06* (2013.01); *H01F 2027/2857* (2013.01)

(58) Field of Classification Search

CPC ..... H01F 27/2847; H01F 27/25; H01F 30/06; H01F 2027/2857

USPC ..... 336/177, 206, 219, 5, 12

See application file for complete search history.

(56) References Cited

U.S. PATENT DOCUMENTS 3,939,449 A * 2/1976 Boyd ..... H01F 27/322 336/183
4,201,965 A * 5/1980 Onyshkevych ..... H01F 27/2804 336/180
4,227,143 A * 10/1980 Elders ..... H01F 38/18 323/355

(Continued)

*Primary Examiner* — Tsz Chan
*Assistant Examiner* — Kazi Hossain
(74) *Attorney, Agent, or Firm* — Aleksandr Smushkovich

(57) ABSTRACT

The proposed transformer includes windings made of a multi-layer ferromagnetic foil tape having an even number m of ferromagnetic layers, coated by interlayer insulation. The winding's upper ends are connected through a first yoke, the winding's bottom ends are connected through a second yoke. Each winding is wrapped by a short-circuited coil, and contains a component for transposition of layers connected in a break at the middle of tape. The insulation's thickness is determined by a ratio of $d_i > u_{n2,\,pic}{}^{*}/(E_{n2,\,pic} \cdot m)$, where $u_{n2,\,pic}$ is a maximum peak voltage between adjacent winding turns, $E_{n2,\,pic}$ is a maximum electric field strength of the insulation. The insulation uses either ferroelectric material $Fe_2O_3$, or multi-layered material with an intensive antiferromagnetic interaction formed as a plurality of pairs of alternating layers of Cu—Fe with a ratio of thicknesses of Cu and Fe ranged from 5:1 to 10:1.

4 Claims, 2 Drawing Sheets

(56) References Cited

U.S. PATENT DOCUMENTS

| | | | | |
|---|---|---|---|---|
| 5,107,390 | A * | 4/1992 | Goldner | H01F 38/08<br>336/178 |
| 2006/0066432 | A1* | 3/2006 | Inuzuka | C04B 35/265<br>336/200 |
| 2012/0154094 | A1* | 6/2012 | Goertz | H01F 27/29<br>336/192 |
| 2013/0099621 | A1* | 4/2013 | Bjorklund | H01B 7/2813<br>310/208 |
| 2015/0097647 | A1* | 4/2015 | Lee | H01L 21/00<br>336/192 |

* cited by examiner

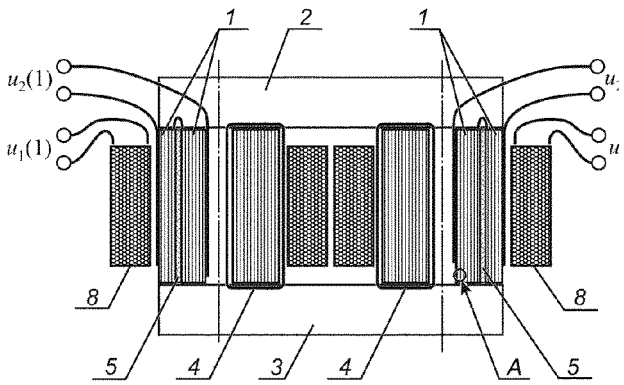
*FIG. 1 – Prior Art*
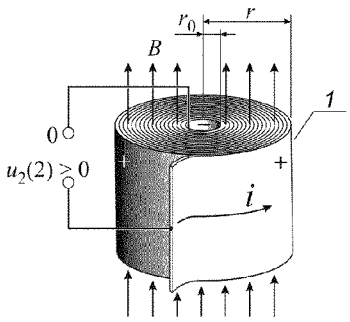
*FIG. 2 – Prior Art*
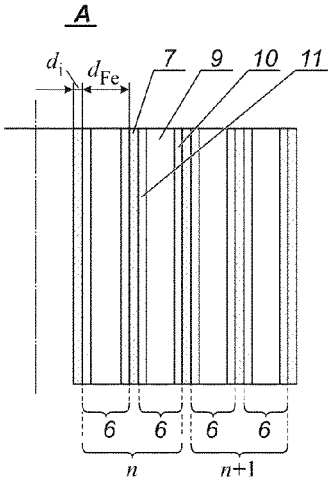
*FIG. 3*
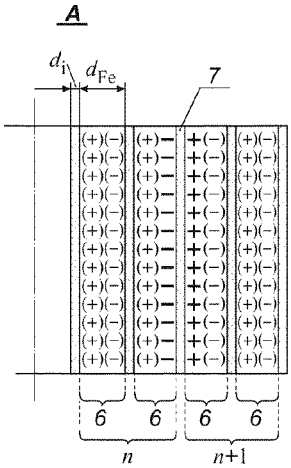
*FIG. 4*
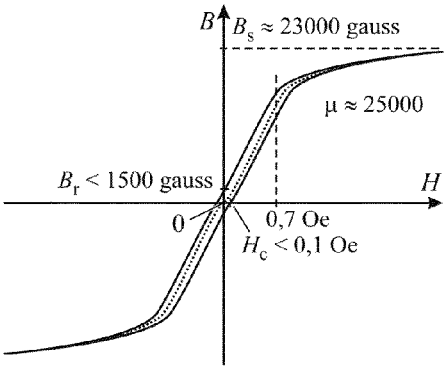
*FIG. 5*
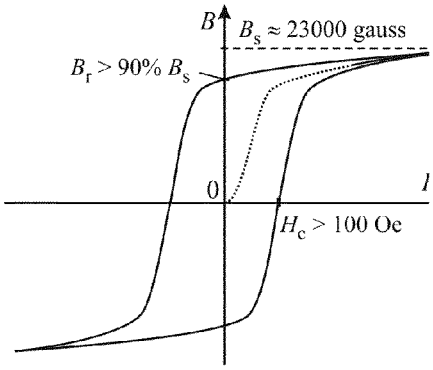
*FIG. 6*

TRANSFORMER WITH FERROMAGNETIC FOIL WINDINGS

FIELD OF THE INVENTION

The invention relates to electrical engineering, and namely to electromagnetic transformers.

BACKGROUND OF THE INVENTION

There is known a method for obtaining of the ferromagnetic state in antiferromagnetic-semiconductor multi-ferroics (ferroelectrics) by the influence of an electric field directed perpendicular to a predetermined layer (a layer under consideration) of these materials (see References [1], [2], [3], [4], [5], and [6] herein below). In the presence of positive charge on an insulated planar electrode which is arranged parallel to the predetermined layer and acts as a source of the electric field; this field displaces conductivity electrons in the layer, and therefore their concentration in the thin volumes of this layer (which are more proximal to the source of the field) increases in relation to the concentration at the initial state, and decreases in the remaining volumes. When the charge of the field source is negative, then the concentration of conductivity electrons decreases in the proximal volumes and increases in other volumes.

The adjustment ranges of this electrical field's intensity allows obtaining a concentration of conductivity electrons in the samples and its gradient, which are sufficient for magnetic spin collectivization, but with incomplete closure of the magnetic flux inside of their groups (see References [7], [8]). This leads to a higher hierarchical grouping (into ferromagnetic domains), consisting of prior smaller association, but also characterized by having a nonzero value of the magnetic moments sum. Therefore, these groups will be similarly associated together into a grouping with the next hierarchical size, having a total magnetic moment different from zero (see Reference [9]). The process of self-assembly of sequences of the magnetic groups with hierarchically growing dimensions will be completed only with a full closure of the magnetic flux in the largest group, the size of which can reach up to the size of the sample of ferromagnetic material.

It should be noted that the increase in the dimension of these groups significantly reduces their rigidity factor (see Reference [10]), therefore the largest groups, even at small changes of the applied magnetic field, will transform into groups having similar dimensions but with a changed value of the total magnetic flux, which may be directed only in accordance with the direction of the external magnetic field.

A sequence of structure re-buildings of the magnetic hierarchical groupings of conductivity electrons is derived in a certain value range from the external magnetizing field, and consists of groupings types, each of which is stable along a very short segment of this range, and while other influences on the material are constant (i.e. the Barkhausen steps), which are described by densely populated energy levels of the conductivity electrons at such states of the material.

Moreover, the adjacent states differ in a small portion of the transition energy (see Reference [11]). This energy difference between such conditionally stable states decreases and the their number becomes greater depending on the choice of material with a greater ratio of large dimensions of the magnetic groups of the conductivity electrons or by creating the conditions to increase their average dimensions (see Reference [10]). The increase of quantitative domination of the large magnetic associations of conductivity electrons increases the material's permeability, which material due to these associations converts into ferromagnetic.

The existence of large-scale magnetic associations of the conductivity electrons, when they are in a sufficient concentration, is confirmed by the prevailing of p-type conductivity in basic ferromagnetic metals and in some antiferromagnetic metals, determined by the positive sign of the Hall coefficient in these materials (see Reference [12]). It also explains the anomalously high free path length of the conductivity electrons without changing the direction of their spins (see References [13, 14]), which proves that the conductivity electrons in ferromagnets and antiferromagnets should be considered only as interconnected in large associations that support the immutable direction of their spin until the break of this linking.

The excessive increase in the concentration of conductivity electrons gives a rise to compaction of these magnetic groups and therefore not only increases the rigidity of these groups, it also causes a strong mutual influence of magnetic leakage fluxes from neighboring groups, oriented antiparallel to the total magnetic moments, i.e. completely closes the magnetic fluxes these groups and prevents the formation of larger electronic groups, and therefore converts ferromagnet in an antiferromagnetic material, i.e. a material insensitive to the external magnetic field.

Conversely, a decrease in the concentration of conductivity electrons in antiferromagnets, converts them into ferromagnets (References [1]-[6]) i.e. a material sensitive to slight changes in the composition and forms of associations of conductivity electrons under small increments of the electric and magnetic fields in a range of technologically applicable changes for these fields. The obtained ferromagnetic property may also be modified by changing the external electric field. Particularly, in the ranges of attainable values, the following properties of the material may be changed: permeability, maximum magnetization, and parameters of the hysteresis loop of magnetization of the material.

The scientific statistics of impurity's influence on the properties of ferromagnetic metals is not enough complete yet. It's usually assumed that impurities attach and insulate the conductivity electrons and make disordered distortions in the crystal structure of metal, and prevent control of its parameters by action of the field. Therefore, in the experiments (see References [1]-[6]), highly purified materials were used, i.e. materials without a distortion of the crystal structure, which allows obtaining a significant anisotropic ferromagnetism along the direction of easy magnetization extending in the plane of the predetermined layer.

The disadvantage of this method for control of the properties of ferromagnetic metals by the external electric field (see References [1]-[6]) is the impossibility to use it for improving the material's parameters in the ferromagnetic foil windings, because theirs turns are electrically series-connected, and therefore the outer turn shields the influence of this field on the underlying layers of the ferromagnetic tape.

There is known a method for changing and measuring parameters of a tested ferromagnetic metal under the action of an electric field thereupon, which electric field is arranged in a double electric layer on the surface of galvanic electrodes made of this metal (see Reference [15]).

Since, in ferromagnetic metals, a tight sequence of the switchable hierarchical magnetic groupings of the conductivity electrons spontaneously (independently from the external influences) arises, it has a low elastic coefficient in relation to influences of not only an electrical but also a magnetic field. Thus, ferromagnetic metals are materials with a high sensitivity to the action of these fields in comparison with other metals.

Therefore, the adjustment ranges of anisotropic magnetic parameters of ferromagnetic material through the action of these external fields, (i.e. of the saturation induction, magnetic permeability and the shape of hysteresis loop of magnetization), will become extended and precise. With a high accuracy, the method (Reference [15]) allows establishing not only ferromagnetic, but also paramagnetic and antiferromagnetic states of the materials, to study the properties of transition and rare metals and their alloys and compounds.

Nevertheless, disadvantages of the method, which make it unusable for adjustment of the parameters of ferromagnetic foil windings, derive from the use of conductive materials for establishing the control electric field on the entire surface of the foil, used in the transformer's winding.

Electrolyte degrades the properties of winding's insulation, and the voltage between the inner and outer winding's turns (while their number is equal N) is N times greater than the inter-turns voltage. Therefore the electrical conductivity of electrolyte may cause a breakdown of the winding's insulation and galvanic corrosion of the metallic foil. Furthermore, because of the electrical conductivity of electrolyte, eddy currents are induced therein, which reduces the efficiency of the transformer, and will increase the size of the winding because of the gaps for passage of electrolyte between the turns, which allows avoiding a shielding of the winding with its external turn.

There is known a method for adjustment of anisotropic magnetic parameters by the action of an electric field applied perpendicular to a ferromagnetic layer (see Reference [16]). Such parameters control in the material with initially ferromagnetic properties significantly expands the range of achievable changes in these parameters by consistently changing the electric field intensity, that allows to get the following material properties: paramagnetic, ferromagnetic, metamagnetic and antiferromagnetic. The disadvantage of this method is the same, i.e. the use of an external electric field, whose influence on the ferromagnetic foil winding is shielded by its outer turn, so that the control of the material's parameters of the winding by this way becomes impossible.

The closest technical solution in the related art is transformers (see References [17]-[21]) containing: the ferromagnetic foil windings (so-called also "windings & core's legs" in the related art), two yokes, the first of which connects the upper ends of these windings, and the second—which connects their lower ends, beside this, each of these windings is made from multi-layer tape having an even number of ferromagnetic metal layers, contains the component for a transposition of these layers which is connected with the break in a middle of the tape's length, and wrapped in the short-circuit turn of the perpendicular degaussing circuit, besides, each layer of this tape is made of the ferromagnetic metal (iron of high 99.997% purity), is coated on the side external to the winding by a layer of antiferromagnetic metal (chromium 99.997%), is coated on another side by the layer of antiferromagnetic material passing into the ferromagnetic state (manganese 99.997%) and is covered with insulation (see References [17]-[21]).

Some types of these transformers (see References [17], [18]) can additionally comprise usual copper windings wrapped around their windings made of ferromagnetic foil. The ferromagnetic foil winding (i.e. windings made of ferromagnetic foil) are active elements of new transformers (References [17]-[21]), which execute two functions: both of the winding, which embraces the cores cross-section or an entire operative time-varying magnetic flux which passes through it, and a function of vertical parts (of legs) of the transformer's ferromagnetic core, along which this main flux of the transformer circulates. In the conventional transformers, the windings (e.g., made of copper) and the legs of the ferromagnetic (e.g., made of electro-technical steel) core, wrapped by these windings, are spatially and functionally separated.

A compactness of the transformers (References [17]-[21]) is achieved not only by the fact that their windings, made of ferromagnetic foil, simultaneously have two functions, i.e. the function of the winding and the function of the ferromagnetic core's leg. This allows reducing almost twice the volume occupied by these components. During the testing of the models of these transformers, for the first time, magnetic interaction between the ferromagnetic layers of these windings was discovered (References [17]-[21]), due to which their spontaneous (i.e. without the influence of an external field) mutual inverse magnetization arises in the direction of their light magnetization, which is parallel to the axis of the windings (Reference [10]).

Such magnetic ordering (magnetic super-lattices with a long-range order) artificially occurs, while winding the coil, and creates existence conditions for a prevailing number of conductivity electron groups having largest dimensions. It increases the relative magnetic permeability of the windings' metal from an initial value 25'000 up to 80'000 and above.

Besides, during operation of the transformers (References [17]-[21]), due to electromagnetic force (emf) induced in the turns of the winding (made of tape of the multi-layer ferromagnetic foil) and due to an active resistive voltage's drop during passage of current through this tape, an electrical potential difference arises between these turns.

The obtained electric field with the spontaneous magnetic field of the layers interaction and the operative magnetic field of the transformer together affect the material of ferromagnetic foil winding. It was found that this action additionally increases the relative permeability of the windings' ferromagnetic material up to values above 100'000.

Therefore, while designing and computing the electromagnetic transformers with ferromagnetic foil windings, it is necessary to take into consideration not only geometrical properties of the magnetic-flux linkage in these windings (Reference [22]), but also the features of magnetic superlattices, i.e. to take into account, that:

1) the magnetic flux in the ferromagnetic foil windings may be directed strictly parallel to the rotation axis of these windings.

2) the operative magnetic flux is uniform in the cross-section of the ferromagnetic foil winding; this fact is proved by the experiment on samples of such windings with any aspect ratios of the inner radius $r_0$ to outer radius r, which gives in every among these cases the same equation for the emf (Reference [22]): $\mathcal{E}=-(\partial\Psi/\partial t)\cdot k_U$, where: $(\partial\Psi/\partial t)$—a change of velocity of the magnetic-flux linkage $\Psi$ passing through the ferromagnetic foil winding; $k_U$—a coefficient related only with the ratio of its radiuses $r_0$ and r, i.e. $k_U=(r+2r_0)/(3r+3r_0)$.

3) in the ferromagnetic material of the foil windings, when it is laminated, owing to a coiling process of these windings, under an influence of the lamination, the ferromagnetic parameters of this material will improve (in comparison with the initial parameters of this material when it is in the form of a thick solid bar), which allows achieving the following: a higher relative magnetic permeability μ, smaller residual magnetization $B_r$ and coercive force $H_c$, and these parameters may be determined by the empirical equations.

4) to ensure the constant direction of the spontaneous magnetization, which shall not change when you move the view along the length of each layer of the multilayer tape, which the ferromagnetic foil winding is made of, the number of these layers must be even. If this requirement is not satisfied, i.e., if the number of these layers is odd, the inner layer of any turn of the foil winding will be located close to the outermost layer of the neighboring previous turn, which has the same direction of magnetization.

This would cause competition between the directions of interacting magnetization and would cause the inversion of a magnetization's direction in one of these adjacent layers (because these directions must be mutual opposite to each other, and owing to it they may provide the closing their total magnetic flux). A common effect of such interactions should be the establishing of magnetization with an alternating direction along the length of each layer of the tape (Reference [10]). The materials ordered in the form of alternating counter directions of magnetization, i.e. the materials having spin valves, are described in detail in References [13], [23].

When the tape has an odd number of layers, along the direction of electric current (i.e. along the tape's length), the spin valves will arise with the amount and random locations, fast varying during a time, which alters the tape resistance in accordance with the function of time, almost harmonically and beginning from an initial value, which was typical for a thick solid bar of applied metals, up to the value, which interrupts this current.

During an experiment (Reference [10]), which was carried out on the foil winding, having an internal diameter 8 mm, outer diameter 25 mm, height 30 mm, 160 turns of a single-layer metallic tape with 50 microns thickness and with 2 microns insulation, while the winding was connected to a sinusoidal current source with 50 Hz frequency and 12 V voltage, the occurrence of the spin valves with variable and random locations along the tapes' length caused a sinusoidal modulation of the winding's resistance with 0.3 Hz frequency. To avoid this undesirable phenomenon, the ferromagnetic foil windings are made of the tape with an even number of layers of ferromagnetic metal.

5) electric current, flowing through the wire connected to the inner terminal of the ferromagnetic foil winding and bended around it's vertical cross section, in spite of limitation of this current (owing to impedance of the electrical circuit of this winding) can cause its magnetization in the direction along its circumference, i.e. transversely in relative to the direction of the transformer's operative magnetic flux, and therefore causes the core permeability's reduction in this direction.

To avoid such undesirable effect of this current, the transformer must contain insulated short-circuited turns, i.e. demagnetizing turns, wrapped around the same vertical cross-section of the ferromagnetic foil windings, which inevitably will be wrapped up with the wires from the internal terminals of these windings. The resistance of these turns is approaching to zero, and for this reason, the currents induced therein are directed oppositely in relation to the currents flowing through the inner leads of these windings and entirely compensate their magnetizing effect.

6) to align the emfs at the ends of the multilayer tape (which will be connected together when welding them to the terminals of the foil winding, and which is wrapped out of this tape), it's necessary to install a component for transposition of these layers described in RU2444077, and this component should be installed in a break of the winding, at the middle point of the tape's length. This allows for a transposition of the tape's layers, i.e. connecting each ending of the tape's layers related to the inner half of the winding (which is conventionally divided in this break), starting from the innermost layer's ending, to the beginning of a corresponding layer of the outer half of this winding, starting from the outer layer's beginning. It ensures a necessary transfer of the currents flowing through the inner layers of the first winding's turns into the outer layers of the last turns, and also reduces the influence of skin-effect.

Changing the sizes and shapes of magnetic associations of the conductivity electrons, (which will be self-defined for selected change ranges of the control electrical field, owing to magnetic interaction of these electrons, mainly between each other, and owing to their electrical interactions therebetween and with other electrons and nuclei of atoms to which they conditionally belong), directly affect the mobility of conductivity electrons and their electromagnetic coupling with the crystal lattice.

Therefore it may be assumed that, by acting perpendicularly on the layer of ferromagnetic metal using an electric field, it is possible to reduce the resistivity of the ferromagnetic tape anisotropically, i.e. along its length.

However, for short pieces having a length that does not exceed a few centimeters, which were used in the experiments (References [1]-[6], [13], [15], [16], [23]), the measurements of decrease of their resistance along the layer were impossible, as these samples' resistance can itself be very accurately taken equal to zero, in comparison with an achievable minimal resistance of the modern measuring devices.

During the experiments (Reference [10]) upon the transformers with ferromagnetic foil windings (References [17]-[21]), the length of iron tapes (which these windings were made of) exceeded 5 m, and for the first time, without any difficulty, this enabled to find and measure (by a voltmeter-ammeter) the decrease of resistance of these tapes under influence of the interlayer electric field arising due to the voltage drop, when electric current flows through these tapes.

In these experiments, it was achieved a decrease of iron resistivity from an initial 0.098 μOhm×m to less than 0.001 μOhm×m, i.e. the metal of ferromagnetic foil windings acquired an increased induced electrical conductivity, which was tens times greater than the conductivity of best known conductors (copper, silver, etc.).

It was also found that, this weak induced hyper-conductivity of ferromagnetic metal, (which exists during the act of electrical and magnetic field thereon, i.e. only during operation these windings, and being at this dependence similar with respect to its improved ferromagnetic parameters), is non-cryogenic (normal), does not disappear (i.e. is stable) until the Curie temperature $T_C$ of the super-lattices up to +350° C. (Reference [10]) and currently may be described according to empirical equations. The decrease of metallic resistivity by using this method is an attractive solution for improving the parameters of the ferromagnetic foil windings.

Therefore, the influence of the electric and magnetic fields on the purest ferromagnetic metals anisotropically change their saturation flux density, permeability, hysteresis magnetization, and electrical conductivity.

For the transformers with ferromagnetic foil windings (References [17]-[21]), which operate at a frequency of f=50 . . . 60 Hz, the most appropriate thickness of the metal layers of the multilayer tape (which these windings are made of), is equal $d_{Fe}$=20 μm that contains a 18 μm substrate layer of 99.996% iron coated by 1 μm of 99.996% manganese on the surface, internal to the winding, and by 1 μm of 99.996% chromium on the opposite surface.

In general, a ratio of the thickness of the iron substrate layer to the total thickness of coatings made of manganese and chromium, is approximately equal 15:1.

Despite the resistivity decrease of ferromagnetic metal, during operation of the transformer, owing to the reduced thickness $d_{Fe}$, a more effective reduction of eddy current losses is provided (than it would be achieved by increasing the metal resistivity ρ). This follows from the fact that an x-times increase of ρ will decrease these losses only x times, while the x-times reducing of $d_{Fe}$ decreases these losses $x^2$ times (Reference [24]). For a selected thickness $d_{Fe}$ (as the skin-effect depth achieves 50 μm), an undesirable influence of the skin-effect is insignificant.

Despite the fact that, because of high initial resistivity ρ of the metal of ferromagnetic multilayered tape (out of which the foil winding is produced), in comparison to the resistivity of copper, for computing the transformers, it proves necessary to increase the total cross-section of the metal tape in proportion to this relative increase of ρ, owing to a volume economy which was used to accommodate the windings; the dimensions of the transformer become at least 2 times less than that for conventional transformers (Reference [22]).

Therefore the related art transformers (References [17]-[21]) are compact, i.e. possess a power density per volume unit more than two times higher than for conventional transformers, have an efficiency exceeding 98% in comparison with the known transformers of conventional design (having an efficiency not higher than 97%), a higher reliability in conjunction with a comprehensive design, and commercial appeal. Furthermore, the design of transformers (References [17-21]) provides for the following advantages:

- the inrush currents (which occur due to sudden switching of voltages and currents) in the transformers, according to References [17]-[21], almost 10 times lower than that of conventional transformers (as mentioned in Reference [22]), owing to a spatial coincidence of ferromagnetic and currents flowing through the winding and inducing magnetization in this ferromagnetic;
- the use of an electrical inter-turn capacitance of the foil windings allows for a full compensation of reactive power consumed by the transformers and electrical power networks associated with these transformers, according to References [17]-[21], (as mentioned in Reference [22]). It is a valuable advantage of the transformers with foil windings.

However, a disadvantage of the transformers, according to References [17]-[21], resides in an insufficient control range of the properties of ferromagnetic metal, which carried out by choosing a thickness $d_{Fe}$ of the ferromagnetic metal, a thickness $d_i$ of the interlayer insulation, and through the use of known transition metals and their alloys with high parameters. These restrictions prevent a possibility of increasing the attainable high values of the magnetic permeability of the core and of attainable high values of conductivity (that is almost hyper-conductivity) of the windings, which is stable at temperatures above +350° C.

These restrictions occur owing to the fact that the relative permittivity ∈* of common types of insulation (which are typically used in the related art) doesn't exceed 3 . . . 6, and this fact doesn't allow for increasing the electric field flux, established between the tape's layers. It should be noted that the electric field, in comparison with the magnetic field, more actively influences ferromagnetic properties of the metal tapes.

Increasing the electric field flux, which may be reached by reducing the thickness $d_i$ of the interlayer isolation (and, respectively, by increasing the electric field intensity), is impossible for the related art transformers, because this isolation must withstand a voltage up to 10 V, and therefore may not be manufactured thinner than 1 μm. Therefore, the adjustment (control) ranges of ferromagnetic properties and electro-conductivity for the foil windings (which adjustment is provided by acting the electromagnetic fields thereon) aren't wide enough, and a theoretically possible compactness, higher than 3-times of that of a conventional transformer, and an efficiency of 99% or more, are not achievable in the related art.

OBJECT AND BRIEF SUMMARY OF THE INVENTION

A primary object of the present invention is to solve the aforementioned problems, and create a transformer with ferromagnetic foil windings having a greater compactness and greater efficiency. Accordingly, there is proposed a transformer including windings made of a multi-layer ferromagnetic foil tape having an even number m of ferromagnetic layers, coated by interlayer insulation. The winding's upper ends are connected through a first yoke, the winding's bottom ends are connected through a second yoke. Each winding is wrapped by a short-circuited coil, and contains a component for transposition of layers (described in RU2444077) connected in a break in the middle of the tape. The insulation's thickness is determined by a ratio of $d_i > u_{n2,\ pic}^*/(E_{n2,\ pic} \cdot m)$, where $u_{n2,\ pic}$ is a maximum peak voltage between adjacent winding turns, $E_{n2,\ pic}$ is a maximum electric field strength of the insulation. The interlayer insulation uses either ferroelectric material being $Fe_2O_3$, or a multi-layered material with intensive antiferromagnetic interaction formed as a plurality of pairs of alternating layers of Cu—Fe with a ratio of thicknesses of Cu and Fe ranged from 5:1 to 10:1.

There is also proposed an interlayer electrical insulation used for a ferromagnetic winding having an even number m of layers; the insulation is coated on the layers; wherein: the insulation has an insulation thickness ($d_i$) determined according to a formula of: $d_i > U_{n2,\ pic}^*/(E_{n2,\ pic} \cdot m)$, where: $U_{n2,\ pic}$ is a maximum peak voltage between adjacent turns of the winding, $E_{n2,\ pic}$ is a maximum electric field strength of the insulation; and—either the insulation is made of $Fe_2O_3$; —or the insulation has a structure consisting of a plurality of pairs of alternating Cu layers having a Cu thickness, and Fe layers having a Fe thickness, wherein a ratio of the Cu thickness to the Fe thickness is equal to 5:100.

BRIEF DESCRIPTION OF THE DRAWINGS

FIG. 1 shows a schematic cross-sectional view of the transformer comprising the ferromagnetic foil windings and which is taken as the closest related art for this invention.

FIG. 2 shows an isometric view of the ferromagnetic foil windings of the transformer shown on FIG. 1.

FIG. 3 and FIG. 4 show a vertical section (A) of the foil winding, whose turns are numbered as 1, 2, 3, . . . , n, n+1, . . . , N and are made out of a tape which has an even m-number of layers of ferromagnetic metal.

FIGS. 5-9 show graphs of empirical dependences of control of ferromagnetic metal parameters in the foil windings, which have interlayer insulation with improved dielectric constant c, related to different thicknesses $d_i$ of the improved insulation.

DESCRIPTION OF PREFERRED EMBODIMENTS OF THE INVENTION

Figure 7:
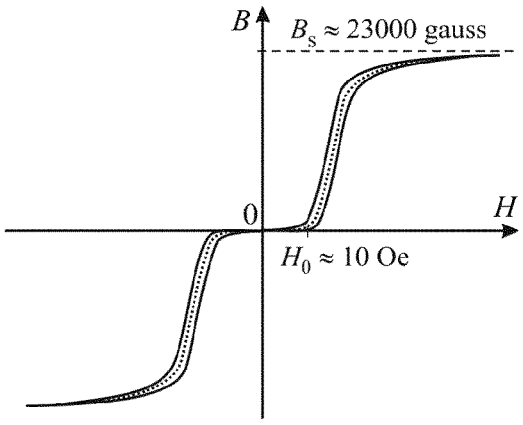

While the invention may be susceptible to embodiment in different forms, there are described in detail herein below, specific embodiments of the present invention, with the understanding that the present disclosure is to be considered an exemplification of the principles of the invention, and is not intended to limit the invention to that as illustrated and described herein.

The inventive object is achieved by the use of special materials for interlayer insulation, which allows increasing the flow of an electric field, therefore, providing an increase of boundaries values of the control range of this field up to the ample values.

The inventive transformer comprises: a number (not limited, for example, 2) of ferromagnetic windings 1 having a vertical cross-section, the ferromagnetic windings 1 are made of a foil tape having a length and wound by an even plurality of layers 6 coated with insulation 7; the layers 6 each is made of ferromagnetic metal 9 wherein, on the external side in relation to the corresponding winding 1, the layer 6 is plated by antiferromagnetic metal 10 and, on the internal side in relation to the corresponding winding 1, the layer 6 is plated by antiferromagnetic metal 11 capable of transferring into a ferromagnetic; the windings 1 each has—upper ends connected through a first yoke 2 and—bottom ends connected through a second yoke 3; the windings 1 each, in the vertical cross-section, is wrapped by a short-circuited coil 4; the windings 1 each contains a component 5 (described in RU2444077) for transposition the layers 6, wherein the component 5 is inserted into a break provided in a middle of the length of the foil tape.

The inventive transformer also comprises: a number of additional copper windings 8 each wrapped around the windings 1.

A distinct feature of the inventive transformer is the material of insulation 7, which is either ferroelectric, or multilayer metallic antiferromagnetic having a plurality of ferromagnetic layers with a strong interaction therebetween, capable of ensuring stability of the ferromagnetic layers against external magnetic and electric fields and insulator properties in the direction of the transition from one of the layers to another such layer.

The transformer's design is similar to the above described related art design, shown on FIG. 1, and has similar windings 1 made of ferromagnetic foil. But, unlike the related art transformer, wherein insulation 7 (shown on FIGS. 3 and 4) is made of a conventional dielectric with relative permittivity $\in^* \approx 3 \ldots 6$, the insulation 7 in the claimed transformer is made of ferroelectric with a relative permittivity $\in > 10^4$, or is made of a laminated metallic antiferromagnetic material having anisotropic insulation properties in the direction of the transition from one its layer to another, having an effective relative permittivity $\in >> 10^4$ and is stable against external magnetic and electric fields at temperature up to +350° C. and more.

The use of ferroelectrics as interlayer insulation in the foil windings of transformers is previously unknown, and therefore the corresponding embodiments of the claimed invention are novel. The application of the laminated metallic antiferromagnetic as anisotropic insulation is also previously unknown, and therefore the corresponding embodiments of the claimed invention are also novel.

Examples of Operation of the Invention

In a preferred embodiment, the inventive transformer operates as follows.

When an alternative voltage $u_1(1)$ is applied to the terminals of a first copper winding 8 (left), which has $N_1(1)$ number of turns, on the terminals of a second copper coil 8 (right), the emf will be induced, which is determined by the classical equation: $u_1(2)=u_1(1)\cdot[N_1(2)/N_1(1)]=u_1(1)\cdot k_{tr}(1)$, i.e. in this case differences in work of a transformer with ferromagnetic foil windings and work of a conventional electromagnetic transformer with the same ratio of turns $k_{tr}(1)=N_1(2)/N_1(1)$ are not observed. However, in this case on the terminals of the ferromagnetic foil winding 1 with a $N_2(1)$ number of turns a voltage $u_2(1)=u_1(1)\cdot[N_2(2)/N_1(1)]\cdot k_U=u_1(1)\cdot k_{tr}\cdot k_U$ (2) will be induced, where: $k_U$—a geometry factor of the winding 1, $k_U=(r+2r_0)/(3r+3r_0)$, $r_0$ and r—its inner and outer radiuses (Reference [22]). This distinguishes the transformers with foil windings made of ferromagnetic metal from conventional electromagnetic transformers.

During operation of the transformer between the adjacent layers 6 relating to the start and finish ends of an every nth turn of the foil winding arises the electrical potential difference $u_{n2}^* \approx (u_{n2}^2+i_2^2\cdot R_{n2}^2)^{1/2}$, where: $u_{n2}$—the emf of the n-th turn, when it is secondary, or its counter-emf, if it is primary; $R_{n2}$—its active resistance; $i_2$—current flowing through the foil winding. Therefore, between these layers 6, the number of which in this turn is equal to m, arises an electric field with the strength $E_{n2}=u_{n2}^*/(d_i\cdot m)$, where: $d_i$—thickness of insulation 7 between the layers 6.

In proportion to the increase of the flux density of electric field between the adjacent layers 6 (which also depends of the relative permittivity c of this insulation, according to the equation: $D_{n2}=\in_0\cdot\in\cdot E_{n2}$), the influence of the electric field on the layers 6 increases as well. Here: $\in_0$—electric constant in the SI-system of the measurements.

Under this action of the electric field, a redistribution of conduction electrons in the volumes of adjacent metal layers 6 occurs, which induces the same redistribution in the density of conductivity electrons in other coterminous layers 6 for all N turns of the ferromagnetic foil winding 1, as shown in the vertical section A on FIG. 4. This alters the quantitative contents, sizes and shapes of the magnetic hierarchical associations of conductivity electrons, and therefore, anisotropically changes properties of the magnetically interacting layers 6 of the foil windings 1 (References [9], [10], [22]) as follows:

- in the direction, parallel to the axis of the foil winding 1, it increases the relative magnetic permeability up to a value $\mu > 100'000$ almost without changing in the saturation flux density equal to $B_s=23'000$ gauss, and decreases the coercive force up to a value $H_c<10^{-4}$ Oe and the remanence up to a value $B_r<100$ gauss;
- longitudinally to the tape, reduces the resistivity up to value $\rho<0.001$ μOhm×m. However, in the related art (References [17-21]), the maximum flow density of electrical displacement $D_{n2}$ in the interlayer volume between the layers of the winding 1 (against influence of which the ferromagnetic material layer 6 is more sensitive, than to the influence of magnetic fields), is limited by a value of relative insulation permittivity equal merely to $\in^*=3 \ldots 6$.

The reduction in the thickness of insulation 7 in order to increase the flow of electrical displacement $D_{n2}$ also has a limit, calculated using the ratio of $d_i > u_{n2,\,pic}^*/(E_{n2,\,pic}\cdot m)$, where: $u_{n2,\ pic}$ is a maximum peak voltage between the adjacent turns of the foil winding 1, $E_{n2,\ pic}$ is a maximal electric field strength in insulation 7 (i.e. a breakdown electric field for the insulation that could be conventionally determined), m—the number of layers in one turn.

Figure 9:
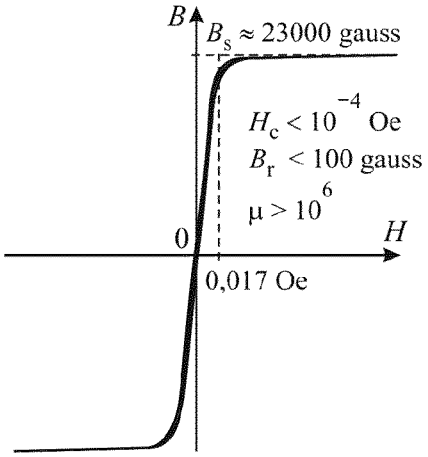

In the related art, this limits the control range of induced properties of the material of ferromagnetic foil winding 1, and therefore does not allow to achieve the best of its parameters (see graphs on FIG. 9).

Unlike in the related art transformers, the interlayer insulation 7 of the claimed transformer is made of ferroelectric or made of multilayer antiferromagnetic with strong interaction between its ferromagnetic layers, the intensity of which is sufficient to ensure an insensitivity of the material against external electric and magnetic fields and creates stable electrical insulating properties in the direction across these layers.

Multilayer material with strong antiferromagnetic interaction between its layers (which does not have structure defects), is usually referred to insensitive materials with anisotropic colossal magneto-resistance (Reference [23]). These types of "insulation" have an equivalent relative permittivity $\in>10^4$, which is anisotropic, i.e. directed (measured) across the layers of this material, and thus, during operation of the claimed transformer, the flux density of the electric field displacement between the metal layers 6 of the tape becomes $(\in/\in^*)$ times greater and proportionally causes higher volume electric charges, which are shown in FIG. 4.

Design Options

Such changing in the concentration of conductivity electrons in the ferromagnetic metal tape in $(\in/\in^*)$ times increases the range of adjustment of its magnetization curve which can be implemented by choosing a ratio of the thickness $d_{Fe}$ of layer 6 and the thickness $d_i$ of interlayer insulation 7, i.e. by design-adjustment of the material in accordance with the empirical equations for these parameters.

Besides, in addition to the adjustment range of the ferromagnetic parameters $\mu$, $H_c$, $B_r$, which occurs at the constant achieved parameter $B_s$ in direction of the tapes width, will be changed also the adjustment range for the resistivity $\rho$ of the ferromagnetic in direction of tapes length. The empirical equations to obtain the best parameters of the ferromagnetic metal in the foil windings with interlayer insulation having the improved dielectric constant can be obtained by applying the magnetization curves shown on FIGS. 5-9.

As a winding model (prototype) for obtaining these curves for the claimed transformers, the ferromagnetic foil winding was designed to operate at the 12V-voltage, which had a power of 100 W, and was suitable for electrical power grids with a frequency of $f_0$=50 . . . 60 Hz.

Measurements were carrying out at a constant value $d_{Fe}$ of thickness of the metal layer 6, which was equal to 20 μm and consisted of a 18 μm tape of 99.996%-purity iron (Reference [10]) coated by 1 μm of 99.996% manganese (Reference [10]) on a first side and coated by 1 μm of the 99.996% chromium on a second side.

Figure 8:
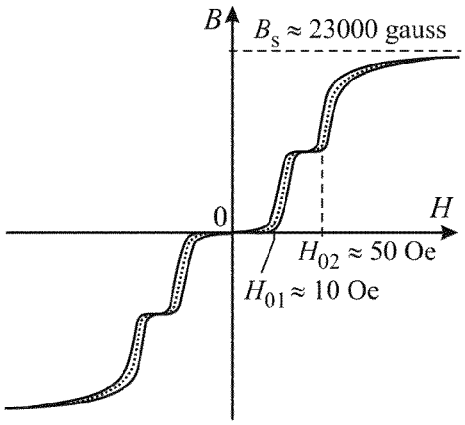

The adjustments, whose results are illustrated in the graphs on FIGS. 5-9, were carried out by varying the thickness $d_i$ of insulation 7 with a relative permittivity $\in_i\approx10^4$. When $d_i\approx5$ μm the magnetization curve of metal corresponds to weak ferromagnetic or paramagnetic (FIG. 5); when $d_i$=0.01 . . . 0.05 μm, there were observed a transition from antiferromagnetic (which doesn't respond to the applied external magnetic field, not shown) to magnetically hard ferromagnetic (FIG. 6); at $d_i$=0.1 . . . 0.5 μm, the magnetization curve corresponds to different types of metamagnets (FIG. 7 and FIG. 8).

If $d_i\approx2$ μm, then the obtained curve corresponds to a desired ferromagnetic with a high saturation induction $B_s\approx23{,}000$ gauss and relative magnetic permeability $\mu>10^6$, small values of remanence $B_r<100$ gauss and of coercive force $H_c<0.017$ Oe (FIG. 9), while the foil winding 1 also acquires a low electrical resistivity $\rho<<0.001$ μOhm×m.

The curve shown on FIG. 9 corresponds to the best parameters of the ferromagnetic foil windings, which are achievable for transformers within a power range of $S_0$=10 W . . . 1 kW, and it was obtained at a thicknesses $d_{Fe}\approx20$ μm, $d_i\approx2$ μm.

The optimum ratio range of thicknesses of metal 6 and insulation 7 in every layer of the foil winding 1 has is raged from 5:1 to 10:1.

For large transformers (having a power $S>S_0$), because of a larger electric voltage between the turns of their windings, the thickness of the interlayer insulation of the tape should be $(S/S_0)^{1/3}$ times greater.

This increase in the insulation thickness reduces the interaction and mutual magnetizing of the ferromagnetic layers and, therefore, reduces the sensitivity of design-adjustment of the electric field up to acceptable values.

In transformers for electrical power grids with a higher frequency f, to eliminate the skin-effect influence, it is required that the thickness $d_{Fe}$ of each metallic layer 6 in the tape and correspondingly the thickness $d_i$ of the interlayer insulation 7 be decreased approximately $(f/f_0)^{1/2}$ times. Therefore, the thickness of the metal layer 6 of the multilayer tape may be determined by the empirical equation: $d_{Fe}\approx20\cdot(100/S)^{1/3}\cdot(50/f)^{1/2}$, μm, where: S—transformer's power, W; f—grid's frequency, Hz.

The multilayered metallic material with a very strong antiferromagnetic interaction of its ferromagnetic layers, which is claimed herein as the alternative (and is a more promising material for the interlayer insulation 7 in the foil windings 1) operates as follows.

When the thicknesses of interlayers of the non-ferromagnetic metal are lower than 5% against the thickness of ferromagnetic metal layers, separated by these interlayers, the spontaneous counter-magnetizing's mutual influence of these ferromagnetic metal layers becomes ten times larger than the influence of a possible peak value of the magnetic field ($H_{max}\geq10$ kOe), which may be induced externally on the laminate material through other parts of an electromagnetic device, for example, by the currents flowing through the windings during the transformer operation.

Therefore, the system of interacting ferromagnetic layers of multilayer material is a permanently locked spin valve (Reference [23]) for currents in the direction across these layers. Material with such high-energy magnetic interaction of the layers may be fully non-conductive in the directions crossing these layers, without sensitivity to an external electrical field and an external magnetic field, unlike metamagnets which react to an applied magnetic field even when their strength is barely above 10 kOe.

As the insulation withstanding a 10 V voltage amplitude, induced between the turns of the ferromagnetic foil windings in the transformers with a power exceeding 1 kW, the material containing more than 5 layers of ultra-pure iron with a thickness of about 90 . . . 100 nm and with copper interlayers having a thickness of 5 nm can be applied. Such system of ferromagnetic layers may be regarded also as electrical capacitor's plates separated by potential barriers at the location of magnetic domain walls, which prevents the passage of current across the layers, wherein the barriers have a thickness no more than a few atoms size.

Therefore, this capacitor's capacitance, owing to its thickness (about 0.5 μm), has a value close to a capacitance value of a capacitor, which would have a 2 μm thickness with insulation interlayers made of ferroelectric with the relative permittivity $\in >> 10^4$. Consequently, multilayered metallic material with very strong antiferromagnetic interaction between its ferromagnetic layers is suitable for use as insulation material of high dielectric permittivity.

Thus, the claimed transformer is provided with a high range of design-adjustment of characteristics of its ferromagnetic foil windings, which allows reducing its sizes in comparison with the related art in more than two-fold and to increase its efficiency up to 99% and higher.

A preferable choice of interlayer insulation 7 for coating the metal layers 6 is a $Fe_2O_3$ film with the 2 μm thickness and having the properties of the dielectric and ferroelectric, i.e. material with resistivity $\rho > 10^{16}$ Ohm×m, with a dielectric strength greater than 60 kV/mm and with $\in > 10^4$.

Another preferable choice of interlayer insulation 7 for coating the metal layers 6 is the multilayer metal material having the 0.5 μm thickness and formed by alternating Cu—Fe—Cu—Fe—Cu . . . layers of super-pure iron and copper with a ratio of corresponding layer thicknesses of 5:100:5:100:5: . . . .

The claimed transformer can be utilized in magneto-electro-technology (as defined by the instant inventors), i.e. in an industry, which uses the properties of layered ferromagnetics for powerful electrical equipment.

The transformer may be adapted for design of single-phase, three-phase, or other transformers with ferromagnetic foil windings, similar to the related art (References [7], [14]-[17]), and may be used as compact power transformers and instrumental transformers with a high reliability in various industrial sectors.

In two-pole connection circuits (i.e. without loading or only with a regulatory loading), the transformer may be used as a choke or reactor. The transformer may be also manufactured for the use in electrical power grids with reactive power compensation.

LIST OF REFERENCES

1. Lebeugle D., Mougin A., Viret M., Colson D., Ranno L. Electric field switching of the magnetic anisotropy of a ferromagnetic layer exchange coupled to the multiferroic compound $BiFeO_3$. Phys. Rev. Lett. 103, 257601 (2009).
2. Kleemann W. Switching magnetism with electric fields. Physics 2, 105 (2009).
3. Martin L. W. et al. Room temperature exchange bias and spin valves based on $BiFeO_3/SrRuO_3/SrTiO_3/Si$ (001) heterostructures. Appl. Phys Lett. 91, 172513 (2007).
4. Smolensky G. A., Chupis I. E. Progress of physical sciences, 1982, Volume 137, No. 3, 415 pages.
5. Tikadzumi S. Physics of ferromagnetism. Magnetic characteristics and practical applications. Moscow: Mir, 1987, 373 pages.
6. Leonid P. Rokhinson, Mason Overby, Alexandr Chernyshov, Yuli Lyanda-Geller, Xinyu Liu, Jacek K. Furdyna. Electrical control of ferromagnetic state. —Journal of Magnetism and Magnetic Materials, 324 (2012)—p. 3379-3384.
7. Savelyev I. V. Electricity and Magnetism//course of common physics. Moscow: Astrel/ACT, 2004—V. 2—p. 336.
8. Levitin R. Z. Magnetism of itinerant electrons//Soros Educational Journal, 1997, No. 6, P. 101-107.
9. Kazakov O. V., Kazakov V. V., Nemtzev G. A. Transformers with reduced inrush current and hysteresis in core. Regional Energy & Electrical Engineering: Problems and Solutions: Issue 7—Cheboksary publ Chuvash. University Press, 2011—P. 235-252.
10. Kazakov V. V. and others. Study of magnetic superlattices with long-range order in the ferromagnetic foil windings.—Kazan: Tatarstan Energy, No 1 (29), 2013.
11. Vonsovski S. V. Magnetism. —Moscow: Science, —1971, 1032 P.
12. Properties of elements. Part I. Physical properties. Handbook./Edited by GV Samsonov—Moscow: Metallurgy, 1976, 600 pp.
13. Binasch G., Grünberg P., Saurenbach F., Zinn W. Enhanced magnetoresistance in layered magnetic-structures with antiferromagnetic interlayer exchange.//Physical Review B 39(7): 4828-4830.
14. Biqin Huang, Douwe J. Monsma, Ian Appelbaum. Coherent Spin Transport through a 350—Micron Thick Silicon Wafer//Physical Review Letters 99, 177209 (2007).
15. RU 2284059, IPC G09B23/18. Method of demonstrate the spontaneous magnetic polarization of the surface (variants) and device for its implementation. 3 Dec. 2004.
16. D. Chiba, S. Fukami, K. Shimamura, N. Ishiwata, K. Kobayashi & T. Ono. Electrical control of the ferromagnetic phase transition in cobalt at room temperature. Nature Materials, V. 10, 2011 p. 853-856.
17. RU 2320045, IPC H01F30/06, H01F27/28. Transformer. 20 Mar. 2008.
18. RU 2393568, IPC H01F30/06, H01F27/28. Transformer. 20 Mar. 2008.
19. RU 2444076, IPC H01F30/06, H01F27/28. Transformer. 3 Aug. 2010.
20. RU 2444077, IPC H01F30/06, H01F27/28. Transformer. 3 Aug. 2010.
21. RU 2448384, IPC H01F30/06, H01F27/28, H01F27/38. Transformer. 3 Aug. 2010.
22. Gureev V. M., Mahyanov K. M., Kazakov V. V. The use of ferromagnetic foil windings as a method of reducing the multiple currents at sharp switching of the inductive components. "Energy Tatarstan."—Kazan, 2013. No. 4 (32).—P. 8-17.
23. Nikitin S. A. Giant magnetoresistance//Soros Surveying magazine.—2004—B. 8.—No. 2.—P. 92-98.
24. Power transformers. Handbook/Ed. Lizunov S. D., Lohanin A. K.—Moscow: Energoizdat, 2004-616 p.

We claim:

1. A transformer comprising:

a number of windings each having a vertical cross-section, said windings are made of a foil tape having a length, said windings are wound by m layers coated with an interlayer insulation, wherein said m is an even positive number; said layers each is made of ferromagnetic metal; said windings each has—upper ends connected through a first yoke and—bottom ends connected through a second yoke; said windings each, in the vertical cross-section, is wrapped by a short-circuited coil; said windings each contains a transposition component for transposition of said layers, wherein the transposition component is inserted into a break provided in a middle of the length of said foil tape;

a number of additional copper windings each wrapped around said windings;

wherein:

said insulation has an insulation thickness ($d_i$) determined according to a formula of: $d_i > u_{n2,\ pic}{}^*/(E_{n2,\ pic} \cdot m)$, where: $u_{n2,\ pic}$ is a conventionally predetermined maximum peak voltage between adjacent turns of said windings, $E_{n2,\ pic}$ is a conventionally predetermined maximum electric field strength of the insulation; and said insulation is made of ferroelectric material having a chemical formula of $Fe_2O_3$.

2. The transformer of claim 1, wherein; said transformer is used in an electric power grid; the layer of said foil tape has a layer thickness defined by the following equation: $d_{Fe} \approx 20 \cdot (100/S)^{1/3} \cdot (50/j)^{1/2}$, where: S is a power of said transformer, f is a frequency of the electric power grid; and a ratio of said layer thickness to said insulation thickness ($d_{Fe}/d_i$) is ranged from 5:1 to 10:1.

3. A transformer comprising:

a number of windings each having a vertical cross-section, said windings are made of a foil tape having a length, said windings are wound by m layers coated with an interlayer insulation, wherein said m is an even positive number; said layers each is made of ferromagnetic metal; said windings each has—upper ends connected through a first yoke and—bottom ends connected through a second yoke; said windings each, in the vertical cross-section, is wrapped by a short-circuited coil; said windings each contains a transposition component for transposition said layers, wherein the transposition component is inserted into a break provided in a middle of the length of said foil tape;

a number of additional copper windings each wrapped around said windings;

wherein:

said insulation has an insulation thickness ($d_i$) determined according to a formula of: $d_i > u_{n2,\ pic}{}^*/(E_{n2,\ pic} \cdot m)$, where: $u_{n2,\ pic}$ is a conventionally predetermined maximum peak voltage between adjacent turns of said windings, $E_{n2,\ pic}$ is a conventionally predetermined maximum electric field strength of the insulation; and said insulation has a structure consisting of a plurality of pairs of alternating Cu layers having a Cu thickness, and Fe layers having a Fe thickness, wherein a ratio of the Cu thickness to the Fe thickness is equal to 5:100.

4. An interlayer insulation used for a ferromagnetic winding having an even positive number m of layers; said insulation is coated on the layers: wherein:

said insulation has an insulation thickness ($d_i$) determined according to a formula of: $d_i > u_{n2,\ pic}{}^*/(E_{n2,\ pic} \cdot m)$, where: $u_{n2,\ pic}$ is a conventionally predetermined maximum peak voltage between adjacent turns of said winding, $E_{n2,\ pic}$ is a conventionally predetermined maximum electric field strength of the insulation; and either said insulation is made of $Fe_2O_3$, or said insulation has a structure consisting of a plurality of pairs of alternating Cu layers having a Cu thickness, and Fe layers having a Fe thickness, wherein a ratio of the Cu thickness to the Fe thickness is equal to 5:100.

* * * * *